United States Patent [19]

Meyer

[11] Patent Number: 4,619,160

[45] Date of Patent: Oct. 28, 1986

[54] POWER WRENCH

[75] Inventor: Alois Meyer, Neunkirchen-Seelscheid, Fed. Rep. of Germany

[73] Assignee: Paul-Heinz Wagner, Much-Birrenbachshöhe, Fed. Rep. of Germany

[21] Appl. No.: 717,548

[22] Filed: Mar. 29, 1985

[30] Foreign Application Priority Data

Apr. 7, 1984 [DE] Fed. Rep. of Germany ..... 3413202

[51] Int. Cl.[4] ..... B25B 13/46

[52] U.S. Cl. ..... 81/57.39

[58] Field of Search ..... 81/57.39

[56] References Cited

U.S. PATENT DOCUMENTS 4,027,561 6/1977 Junkers ..... 81/57.39
4,200,011 4/1980 Wilmeth ..... 81/57.39
4,440,046 4/1984 Hirtsiefer et al. ..... 81/57.39
4,524,651 6/1985 Dabiel et al. ..... 81/57.39

*Primary Examiner*—James L. Jones, Jr.
*Attorney, Agent, or Firm*—Spensley Horn Jubas & Lubitz

[57] ABSTRACT

The piston-cylinder unit (30') of a power wrench presses against the arm (16), by means of a ball and socket joint (44, 45), for swivelling the ring (11), which is connected secure against rotation to the wrench head to be turned. The piston (35) and the arm (16) have complementary spherical surfaces (40, 41) which press against each other. The dimensions of the spherical surfaces can be selected in dependence on the maximum power to be transmitted. The result is a uniform power distribution and a force-free adaptation of the movements of piston (35) and arm (16), without jamming and tilting.

9 Claims, 5 Drawing Figures

POWER WRENCH

Figure 1:
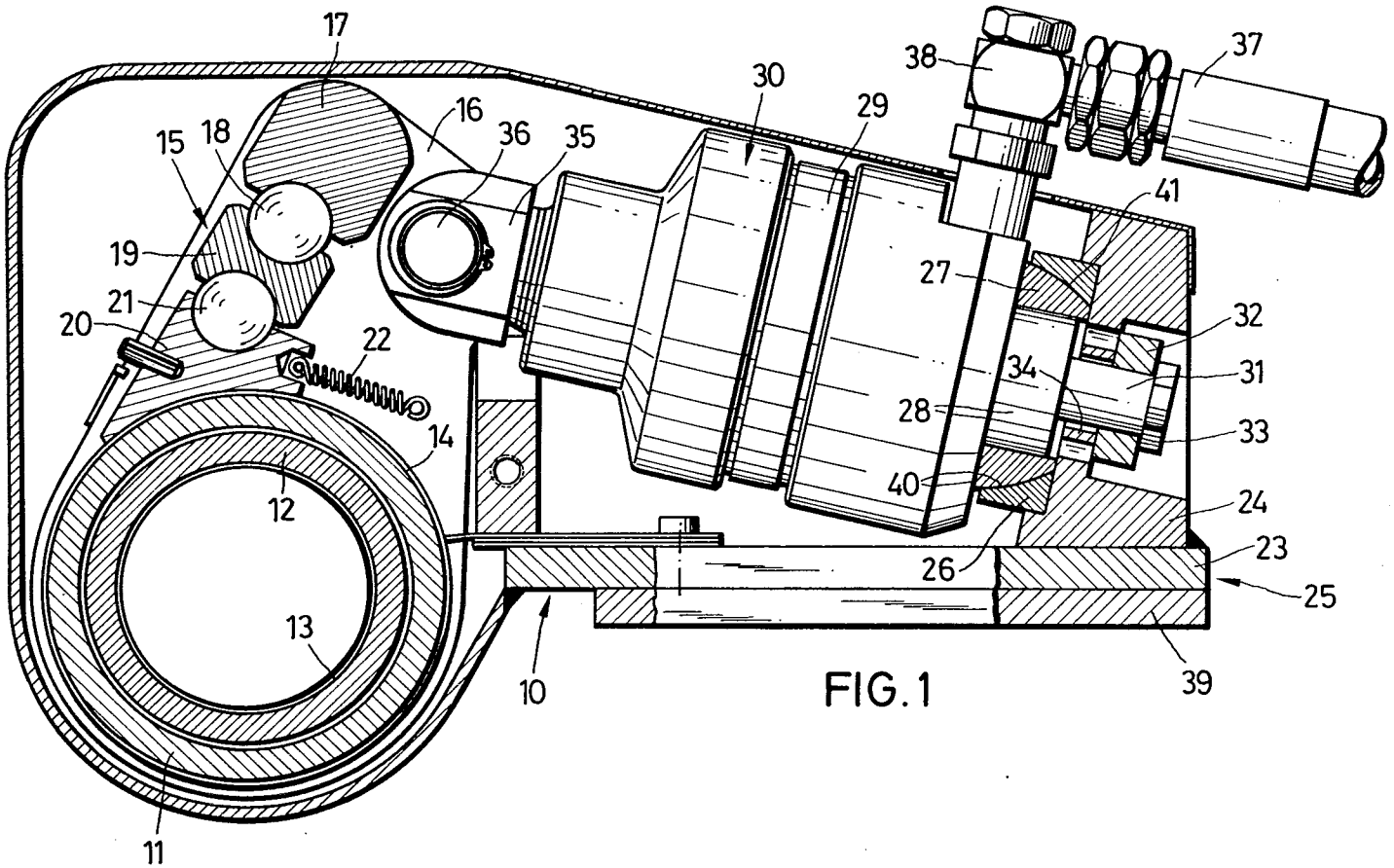

The invention relates to a power wrench with a ring that can be connected to a wrench head, and a piston-cylinder unit which is supported on a holder that is rotatable relatively to the ring and presses against an arm distant from the ring.

Power wrenches are used to turn wrench heads, pipes or the like, with high torque. They contain a piston-cylinder unit whose piston presses against the arm of the ring and whose cylinder is supported on a holder. There are power wrenches with which the piston-cylinder unit is connected to the holder or the arm at both its ends by means of joints, and there are also versions with which the cylinder forms an integral component of the holder, so that only the outer end of the piston has to be connected to the arm by means of a joint. In each case there is a joint at least at one end of the piston cylinder unit so as to make possible the adjustment of movement between the piston-cylinder unit and the arm in different stroke positions. If great forces are applied then the joints are exposed to great stresses so that the joints undergo great wear and tear. The stress is frequently increased by the fact that the parts which join the joint together are not in exact alignment with each other but are slightly tilted or offset. In such cases there are great surface pressures and great wear.

The aim of the invention is to produce a power wrench of the type mentioned at the beginning, with which the force of the piston-cylinder unit is uniformly distributed on the adjacent joint, so that there is less surface stress, whereby faulty alignments of the jointed parts can be compensated.

According to the invention, the solution of this exercise lies in the fact that at least one of the ends of the piston-cylinder unit has a convex or concave spherical surface which abuts with all its surface against a complementarily formed spherical surface of the holder or of the attachment.

In operation of the power wrench, although the piston-cylinder unit always carries out only backwards and forwards swivel movements in one single plane, for the movement compensation no shaft bearings are used, but spherical bearings. It has been seen that a spherical bearing can transmit much greater pressure forces than a shaft bearing. Both the local peak loads and also the wear are considerably less with a spherical bearing than with a shaft bearing. In addition fewer parts are required that are subject to wear, in fact only the two parts on which the spherical surfaces are located. Since the friction is distributed over relatively large surfaces, great forces can be transmitted. With spherical surfaces the supporting surface can be enlarged by any amount at all—unlike with a pin joint. The spherical surfaces give a better contact reflection and they can be made very simply and very economically.

According to a first embodiment of the invention, provision is made for the holder to be a frame or a housing, on which the cylinder of the piston-cylinder unit is supported with a ball and socket joint. The ball and socket joint allows the adjustment of the entire piston-cylinder unit to the respective alignment of the arm distant from the ring.

In a second embodiment of the invention there is provided on the piston of the piston-cylinder unit a first spherical surface and on the arm a second spherical surface that is complementary to this. The cylinder can be made in one piece with the holder so that a pressure-transferring joint is not necessary between the holder and the cylinder.

Some embodiments of the invention are described in detail below with reference to the drawings.

Figure 2:
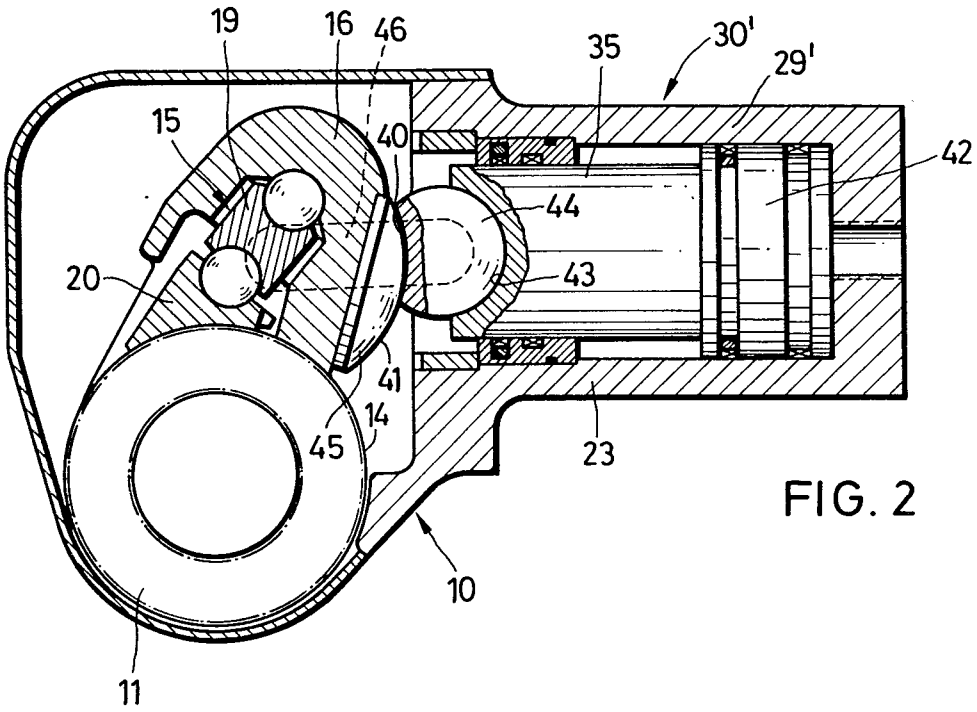
Figure 3:
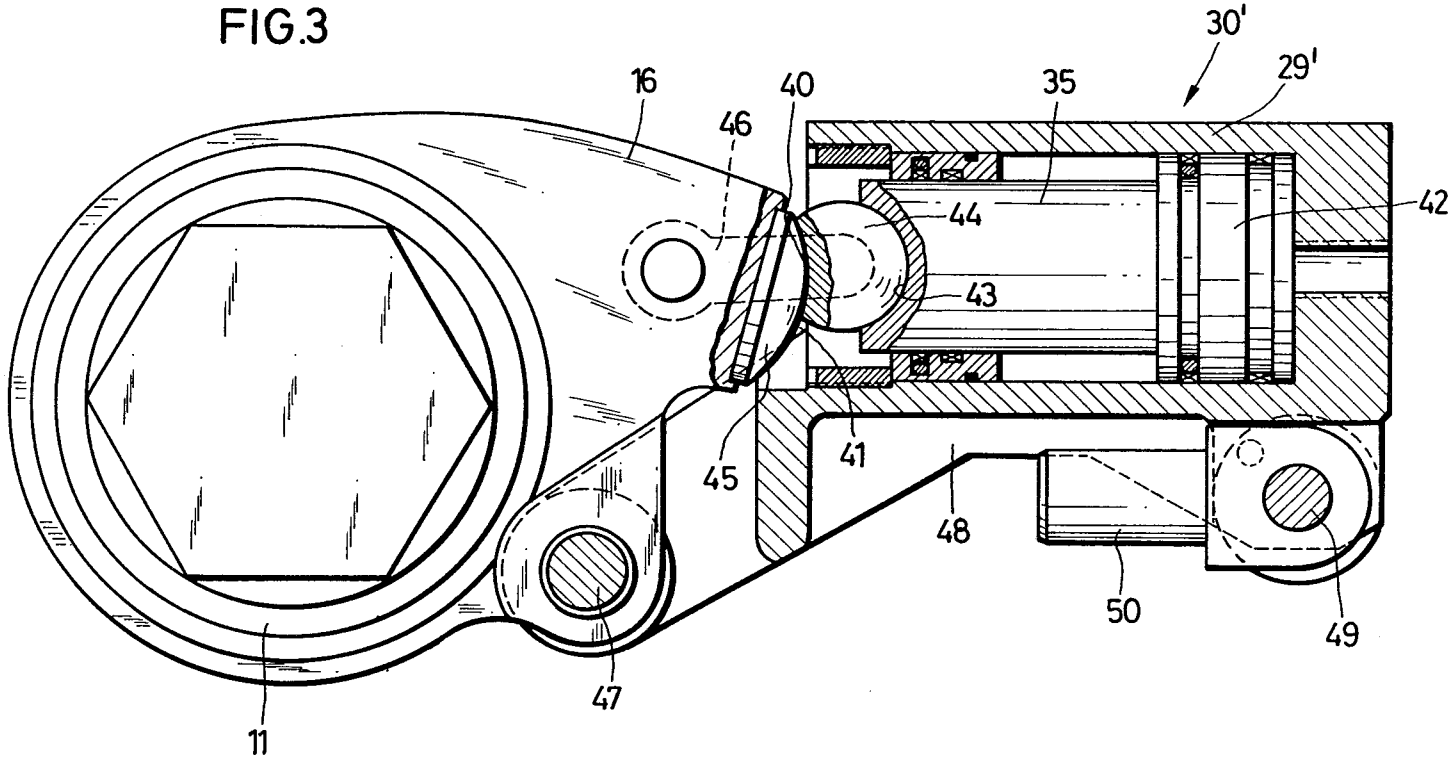
Figure 4:
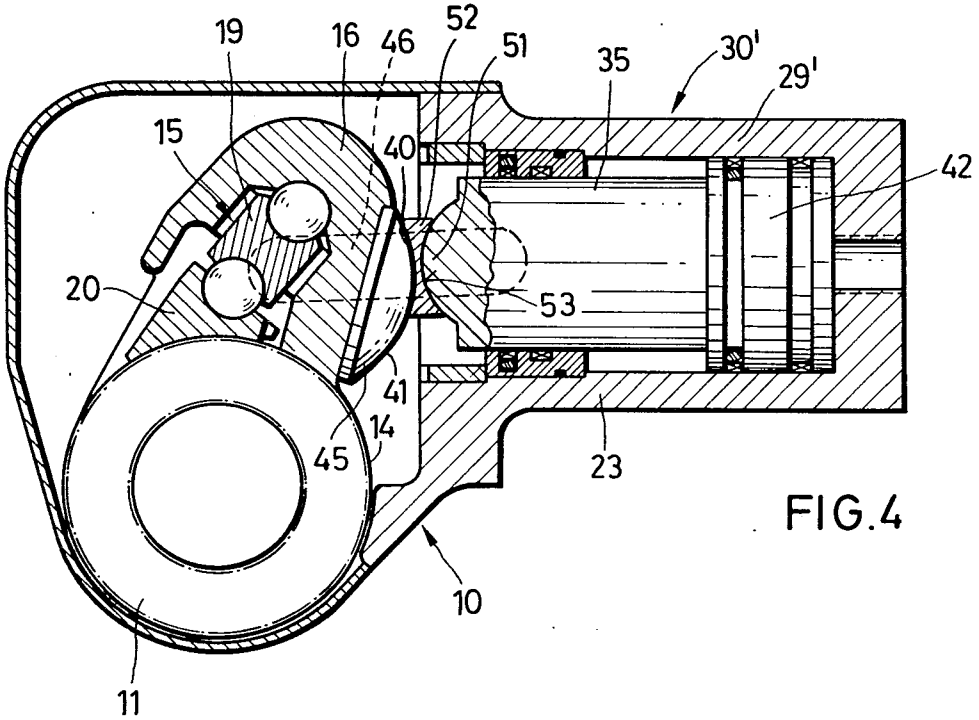
Figure 5:
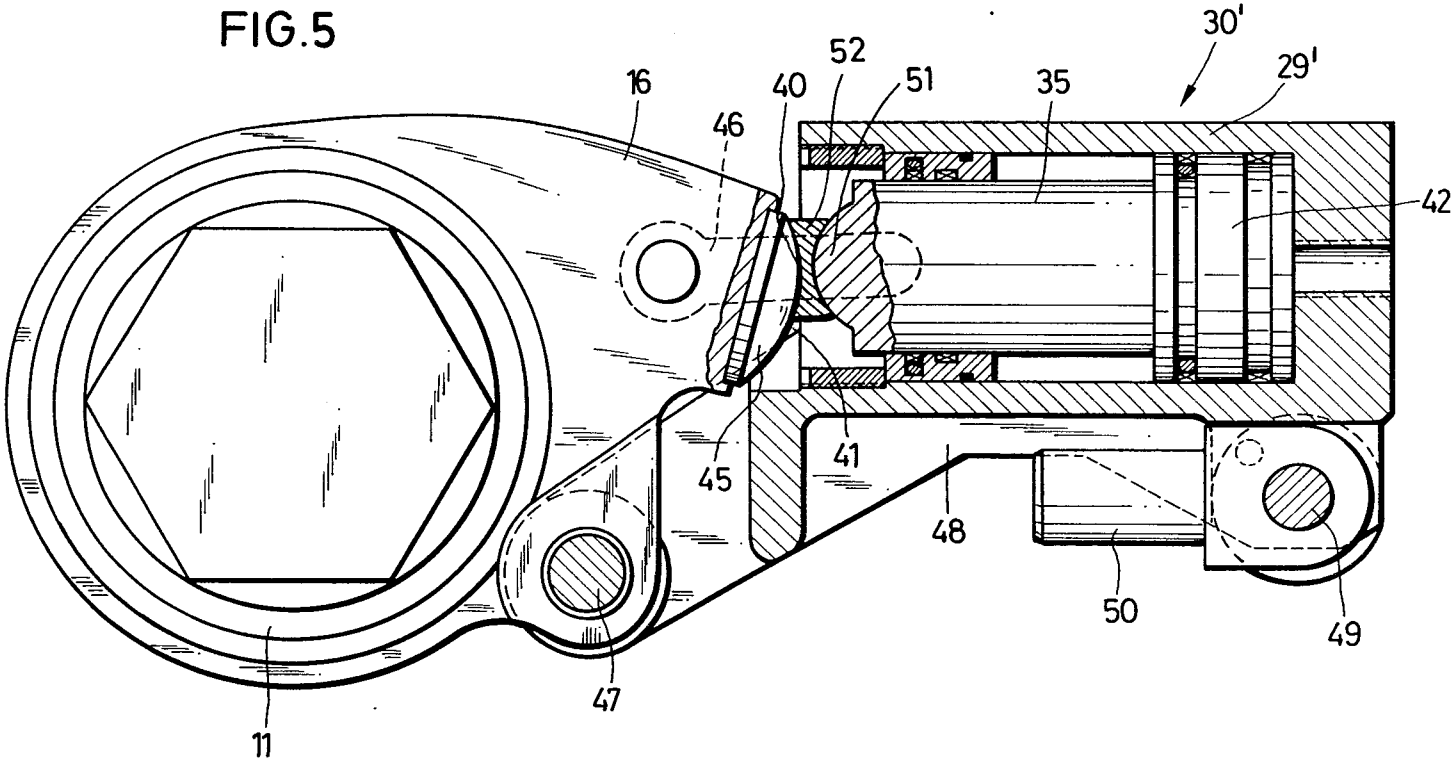

These show:

FIG. 1 a longitudinal section through a first embodiment of the power wrench, FIG. 2 a longitudinal section through a second embodiment, FIG. 3 a schematic representation of a third embodiment and FIGS. 4 and 5 modified embodiments of FIGS. 2 and 3.

The power wrench has a frame or a housing 10 in which a ring 11 is rotatably mounted. An adapter ring 12 is inserted into internal toothing of the ring 11 and this adapter ring has an internal profile 13 which can be placed onto a wrench head or a button die so that the ring 11 is fixedly connected to the wrench head or the button die secure against rotation. A ratchet lever 15 co-operates with the external toothing 14 of the ring 11, and this lever comprises an elbow lever mechanism which is supported on the end of the arm 16. The arm 16 is mounted co-axially to the ring 11 and it can be swivelled about the common axis relatively to this ring 11. On the attachment 16 there is located an abutment 17 on which a block 19 is supported via a ball 18. The ratchet shoe 20 presses against the other end of the block 19 by means of a further ball 21. The block 19 together with the ratchet shoe 20 and the two spherical parts of the universal joint 18 and 19 forms the elbow lever mechanism of the ratchet lever 15. A spring 22 draws the toothing of the ratchet shoe 20 in the direction of the outer toothing 14 of the ring 11. The arm 16 can rotate relatively to the ring 11 in the clockwise direction. However, if the arm 16 is turned in the anti-clockwise direction, it entrains the ring 11 by means of the ratchet lever 15.

The housing 10 has a rigid plate 23 with an abutment 24 secured to it. The plate 23 with the abutment 24 forms the holder 25. On the abutment 24 there is secured a ball socket 26, in which a spherical segment 27 is located. Through a central bore of the spherical segment 27 projects the shaft 28 of the cylinder 29 of the piston-cylinder unit 30.

A pin 31, which forms an extension of the shaft 28, projects through an aperture in a wall of the abutment 24. Behind the aperture an elastomeric cushion 32 is pushed on the pin 31 and secured with a nut 33. The elastomeric cushion 32 is located between the wall 34 of the abutment 24 and the nut 33.

The end of the piston rod 35 of the piston-cylinder unit 30 is connected via a jointed shaft 36 to the arm 16. Supplying the piston-cylinder unit with pressure is effected by means of the hydraulic lines 37 which are connected to joint couplings 38 which project out of an aperture of the housing 10. Under the plate 23 there is located a support plate 39 so as to support the housing against a fixed abutment.

In operation of the power wrench, the piston of the piston-cylinder unit 30 is so controlled that it makes backwards and forwards movements. Thus the arm 16 is swivelled to and fro about the axis of the ring 11, whereby the ring 11 is entrained in stages by the ratchet lever 15. During the to- and fro- movements the cylinder 29 carries out pivoting movements round the centre point of the ball and socket joint 26, 27, whose ball socket 26 is located in a corresponding depression of the abutment 24. The annular concave spherical surface of the ball socket 26 is referenced 40, and the annular convex spherical surface of the spherical segment 27 is referenced 41. The two spherical surfaces 40 and 41 fit onto each other and make possible a surface pressure transmission from the cylinder 29 to the abutment 24 during each of the angular positions of the piston cylinder unit considered.

In the embodiments of FIGS. 2 and 3 those parts which correspond to specific parts in FIG. 1 are provided with the same references. The piston-cylinder unit 30' has no independent cylinder housing. Rather is the cylinder 29' constructed in one piece with the holder 23. At the end of the piston rod 35 of the piston 42 there is secured in a segment-shaped recess 43 a ball 44 which has on its outside a segment-shaped trough which forms the concave spherical surface 40. The radius of this spherical surface 40 is considerably greater than the radius of the ball 44. The convex spherical surface 41 of a spherical segment 45 secured on the arm 16 presses against the concave spherical surface 40. The diameter of the spherical surface 41 corresponds to that of the spherical surface 40 so that the two spherical surfaces 40 and 41 lie next to one another surface-wise.

If the piston 42 moves to the left through the pressure in the cylinder 29' according to FIG. 2, then the ball 44 presses the spherical segment 45 and hence the arm 16 to the left. The concave spherical surface 40 thus travels along the convex spherical surface 41. This shifting means that the cylinder 29' can be rigid without the necessity of a guide rod mechanism between the piston 42 and the arm 16.

Since between the ball parts 44 and 45 pressure forces exclusively can be transmitted, the arm 16 is connected to the piston rod 35 via a traction element 46, so that the piston 42 can entrain the arm 16 on its return movement (to the right). The traction element 46 is a flat spring resilient in the longitudinal direction, or a rigid bracket with a resilient bearing in one or in both receiver bores. The traction element presses the two ball parts 44 and 45 against each other with a slight initial stressing force and holds them firmly in their position.

According to FIG. 2 the ball 44 has a double function, namely on the one hand the surface support in the recess 43 of the piston rod 35 and on the other hand the surface co-operation of the spherical surface 40 with the spherical surface 41 of the arm 16.

The embodiment of FIG. 3 corresponds substantially to that of FIG. 2 so that the subsequent description can be limited to the differences. In contrast to the earlier embodiments, the arm 16 is not coupled to the ring 11 by means of a ratchet, but is firmly connected to this ring. A holder 48 engages onto a jointed shaft 47 of the ring 11, which holder is in turn connected firmly to the cylinder 29' of the piston-cylinder unit 30. On the cylinder 29' there is fitted, by means of a further jointed shaft 49, a pivotable pin 50, onto which can be put a support leg which can be applied against a fixed abutment so as to lead away the reaction force occurring during screwing.

The power wrench according to FIG. 3 works in principle just like the power wrench of FIG. 2. With each stroke, the piston-cylinder unit 30' carries out swivel movements which are compensated by the co-operation of the spherical surfaces 40 and 41. If there is no ratchet present, after each stroke there must be a change of the ring 11 on the wrench head. In the present example, the ratchet (not shown) is fitted in the arm 16.

With a small format and compact construction, the power wrench of the invention allows the use of extremely high torques with a small amount of wear on the joints formed by the spherical surfaces. A particular advantage lies in the fact that with joints of FIGS. 2 and 3, not only rotary movements but also swivelling movements occur. According to FIG. 3 the traction element 46 is a guide rod, and the centre points of the spherical surfaces 40 and 41 lie on the jointed shafts of the guide rod 46.

The embodiment according to FIG. 4 corresponds substantially to that of FIG. 2. Instead of the ball 44 there is provided on the front of the piston rod 35 an elevation 51 in the form of a spherical segment. Between the spherical surface of the elevation 51 and the spherical surface 41 there is a thrust piece 52 which has two opposite concave spherical surfaces 40 and 53. The radius of the concave spherical surface 40 is adapted to the radius of the convex spherical surface 41. This radius is greater than that of the concave spherical surface 53 which is adapted to the convex spherical surface of the elevation 51. Since the segment 45 is drawn by the traction element 46 in the direction of the elevation 51, special securing elements are not necessary for the thrust piece 52.

The embodiment of FIG. 5 is like that of FIG. 3, but wherein there is provided on the piston 35 a spherical elevation 51 instead of the trough 43. Between the elevation 51 and the segment 45 of the arm 16 there is here also a thrust piece 52, as was described by means of FIG. 4.

I claim:

1. In a power wrench of the type provided with an arm supporting a ring placeable over a wrench head, and a piston cylinder unit coupled at one end to the arm at a position on the arm distant from the ring, the piston-cylinder unit for turning a wrench head placed in said ring by moving the arm to rotate it about the axis of the ring, the improvement comprising:

a spherical bearing member located between said arm and said piston-cylinder unit, said spherical bearing member having generally oppositely disposed first and second spherical surfaces of different radii of curvature, the radius of curvature of said second spherical surface being greater than that of said first spherical surface;

a first complementary surface to said first spherical surface, said first complementary surface located at said first end of said piston-cylinder unit and slidably contacting said first spherical surface of said spherical bearing member; and a second complementary surface to said second spherical surface, said second complementary surface located on said arm at said position on the arm distant from the ring and slidably contacting said second spherical surface of said spherical bearing member, contact between said spherical surfaces and their respective complementary surfaces being maintained when said piston-cylinder unit turns said wrench head.

2. The improvement of claim 1 wherein said second spherical surface is a concave surface and said second complementary surface is a convex surface of the same radius of curvature as said second spherical surface and larger than said second spherical surface so that said second spherical surface can slide across said second complementary surface as said cylinder unit turns the wrench head.

3. The improvement of claim 2 wherein said first spherical surface is a concave surface and said first complementary surface is a convex surface having the same radius of curvature as said first spherical surface.

4. The improvement of claim 2 wherein said first spherical surface is a convex surface and said first complementay surface is a concave surface having the same radius of curvature as said first spherical surface.

5. A power wrench comprising:

an arm supporting a ring connectable to a wrench head at a first end of said arm;

a housing carrying a piston-cylinder unit having a first end coupled to said arm at a position distant from said ring for rotating said arm about the axis of the ring, and a second end coupled to said housing, said housing for abutment against a fixed object; and a bearing member coupling said arm and said first end of said piston-cylinder unit, said bearing member having first and second spherical surfaces, said first spherical surface of a first radius of curvature and for contact with a first complementary surface on said arm at said position distant from said ring, and said second spherical surface of a second radius of curvature smaller than the first radius of curvature and for contact with a second complementary surface at said first end of said piston-cylinder unit, said first and second spherical surfaces remaining in contact with their corresponding complementary surfaces as said piston-cylinder unit rotates said arm despite misalignments between said arm and said piston-cylinder unit.

6. A power wrench as in claim 5 wherein said bearing member is a truncated ball of said second radius and said first spherical surface is a concave depression on said truncated ball.

7. A power wrench as in claim 5 wherein said bearing member has two concave surfaces forming the first and second spherical surfaces.

8. A power wrench as in claim 5 wherein said first complementary surface is of larger area than said first spherical surface, and said first spherical surface slides over said first complementary surface when said piston-cylinder unit moves said arm.

9. A power wrench as in claim 5 further comprising a ball and socket joint connecting said housing to the second end of said piston-cylinder unit.

* * * * *